US009284837B2

(12) United States Patent
Proett et al.

(10) Patent No.: US 9,284,837 B2
(45) Date of Patent: Mar. 15, 2016

(54) FOCUSED PROBE APPARATUS AND METHOD THEREFOR

(75) Inventors: Mark A. Proett, Houston, TX (US); Anthony H. van Zuilekom, Houston, TX (US); Gregory N Gilbert, Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 2111 days.

(21) Appl. No.: 12/442,347

(22) PCT Filed: Sep. 21, 2007

(86) PCT No.: PCT/US2007/020472

§ 371 (c)(1),
(2), (4) Date: Feb. 16, 2010

(87) PCT Pub. No.: WO2008/036395

PCT Pub. Date: Mar. 27, 2008

(65) Prior Publication Data

US 2010/0132940 A1 Jun. 3, 2010

Related U.S. Application Data

(60) Provisional application No. 60/826,709, filed on Sep. 22, 2006.

(51) Int. Cl.
*E21B 49/10* (2006.01)

(52) U.S. Cl.
CPC ..... *E21B 49/10* (2013.01)

(58) Field of Classification Search
USPC ..... 166/100, 264; 73/152.26, 152.24
See application file for complete search history.

(56) References Cited

U.S. PATENT DOCUMENTS

| | | | | |
|---|---|---|---|---|
| 5,473,939 | A * | 12/1995 | Leder et al. | 73/152.12 |
| 6,301,959 | B1 | 10/2001 | Hrametz et al. | |
| 2004/0173351 | A1 | 9/2004 | Fox et al. | |
| 2005/0257629 | A1 | 11/2005 | Gilbert et al. | |
| 2006/0000603 | A1 | 1/2006 | Zazovsky et al. | |
| 2006/0076132 | A1 | 4/2006 | Nold, III et al. | |

FOREIGN PATENT DOCUMENTS

| | | | |
|---|---|---|---|
| EP | 1316674 | A1 | 6/2003 |
| GB | 2418938 | A | 4/2006 |
| WO | WO-0043812 | A1 | 7/2000 |
| WO | WO-2008036395 | A1 | 3/2008 |

OTHER PUBLICATIONS

"International Application Serial No. PCT/US2007/020472, International Search Report mailed Jan. 16, 2008", 2 pgs.
"Australian Application Serial No. 2007297613, First Examiner Report mailed on May 31, 2010", 2 pgs.
"International Application Serial No. PCTIUS2007/020472, Written Opinion mailed Jan. 16, 2008", 6 pgs.
(Continued)

*Primary Examiner* — David Andrews
(74) *Attorney, Agent, or Firm* — Schwegman Lundberg & Woessner, P.A.; Benjamin Fite

(57) ABSTRACT

Apparatus and methods for downhole formation testing including use of a probe having inner and outer channels adapted to collect or inject injecting fluids from or to a formation accessed by a borehole. The probe straddles one or more layers in laminated or fractured formations and uses the inner channels to collect fluid.

14 Claims, 6 Drawing Sheets

(56) References Cited

OTHER PUBLICATIONS

"United Kingdom Application Seriai No. 0904501.4, Examination Report mailed Jan. 7, 2011", 3 pgs.
"United Kingdom Application Serial No. 0904501.4, Response filed May 25, 2011 to Office Action mailed Mar. 31, 2011", 12 pgs.
"United Kingdom Application Serial No. 0904501.4, Response filed Mar. 18, 2011 to Office Action mailed Jan. 7, 2011", 26 pgs.
"United Kingdom Application Serial No. 0904501.4, Office Action mailed Mar. 31, 2011", 1 pg.
"Malaysian Application Serial No. PI 20091018, Clear Substantive Examination Adverse Report mailed Jun. 13, 2014", 1 pg.

* cited by examiner

FOCUSED PROBE APPARATUS AND METHOD THEREFOR

RELATED APPLICATIONS

This application is a U.S. National Stage Filing under 35 U.S.C. 371 from International Application Number PCT/US2007/020472, filed Sep. 21, 2007 and published in English as WO 2008/036395 A1 on Mar. 27, 2008, which claims the benefit under U.S. Provisional Application Ser. No. 60/826,709, filed Sep. 22, 2006, under 35 U.S.C. 119(e), which applications and publication are incorporated herein by reference in their entirety.

FIELD

The subject matter relates to underground formation investigation, and more particularly, apparatus and methods for formation testing and fluid sampling within a borehole.

BACKGROUND

The oil and gas industry typically conducts comprehensive evaluation of underground hydrocarbon reservoirs prior to their development. Formation evaluation procedures generally involve collection of formation fluid samples for analysis of their hydrocarbon content, estimation of the formation permeability and directional uniformity, determination of the formation fluid pressure, and many others. Measurements of such parameters of the geological formation are typically performed using many devices including downhole formation testing tools.

During drilling of a wellbore, a drilling fluid ("mud") is used to facilitate the drilling process and to maintain a pressure in the wellbore greater than the fluid pressure in the formations surrounding the wellbore. This is particularly important when drilling into formations where the pressure is abnormally high: if the fluid pressure in the borehole drops below the formation pressure, there is a risk of blowout of the well. As a result of this pressure difference, the drilling fluid penetrates into or invades the formations for varying radial depths (referred to generally as invaded zones) depending upon the types of formation and drilling fluid used. The formation testing tools retrieve formation fluids from the desired formations or zones of interest, test the retrieved fluids to ensure that the retrieved fluid is substantially free of mud filtrates, and collect such fluids in one or more chambers associated with the tool. The collected fluids are brought to the surface and analyzed to determine properties of such fluids and to determine the condition of the zones or formations from where such fluids have been collected.

One feature that all such testers have in common is a fluid sampling probe. This may consist of a durable rubber pad that is mechanically pressed against the rock formation adjacent the borehole, the pad being pressed hard enough to form a hydraulic seal. Through the pad is extended one end of a metal tube that also makes contact with the formation. This tube is connected to a sample chamber that, in turn, is connected to a pump that operates to lower the pressure at the attached probe. When the pressure in the probe is lowered below the pressure of the formation fluids, the formation fluids are drawn through the probe into the well bore to flush the invaded fluids prior to sampling. In some prior art devices, a fluid identification sensor determines when the fluid from the probe consists substantially of formation fluids; then a system of valves, tubes, sample chambers, and pumps makes it possible to recover one or more fluid samples that can be retrieved and analyzed when the sampling device is recovered from the borehole.

It is important that only uncontaminated fluids are collected, in the same condition in which they exist in the formations. Often the retrieved fluids are contaminated by drilling fluids. This may happen as a result of a poor seal between the sampling pad and the borehole wall, allowing borehole fluid to seep into the probe. The mudcake formed by the drilling fluids may allow some mud filtrate to continue to invade and seep around the pad. Even when there is an effective seal, borehole fluid (or some components of the borehole fluid) may "invade" the formation, particularly if it is a porous formation, and be drawn into the sampling probe along with connate formation fluids.

Additional problems arise in Drilling Early Evaluation Systems (EES) where fluid sampling is carried out very shortly after drilling the formation with a bit. Inflatable packers or pads cannot be used in such a system because they are easily damaged in the drilling environment. In addition, when the packers are extended to isolate the zone of interest, they completely fill the annulus between the drilling equipment and the wellbore and prevent circulation during testing.

There is a need for an apparatus that reduces the leakage of borehole fluid into the sampling probe, and also reduces the amount of borehole fluid contaminating the fluid being withdrawn from the formation by the probe. Additionally, there is a need for an apparatus that reduces the time spent on sampling and flushing of contaminated samples.

DESCRIPTION

Figure 1:
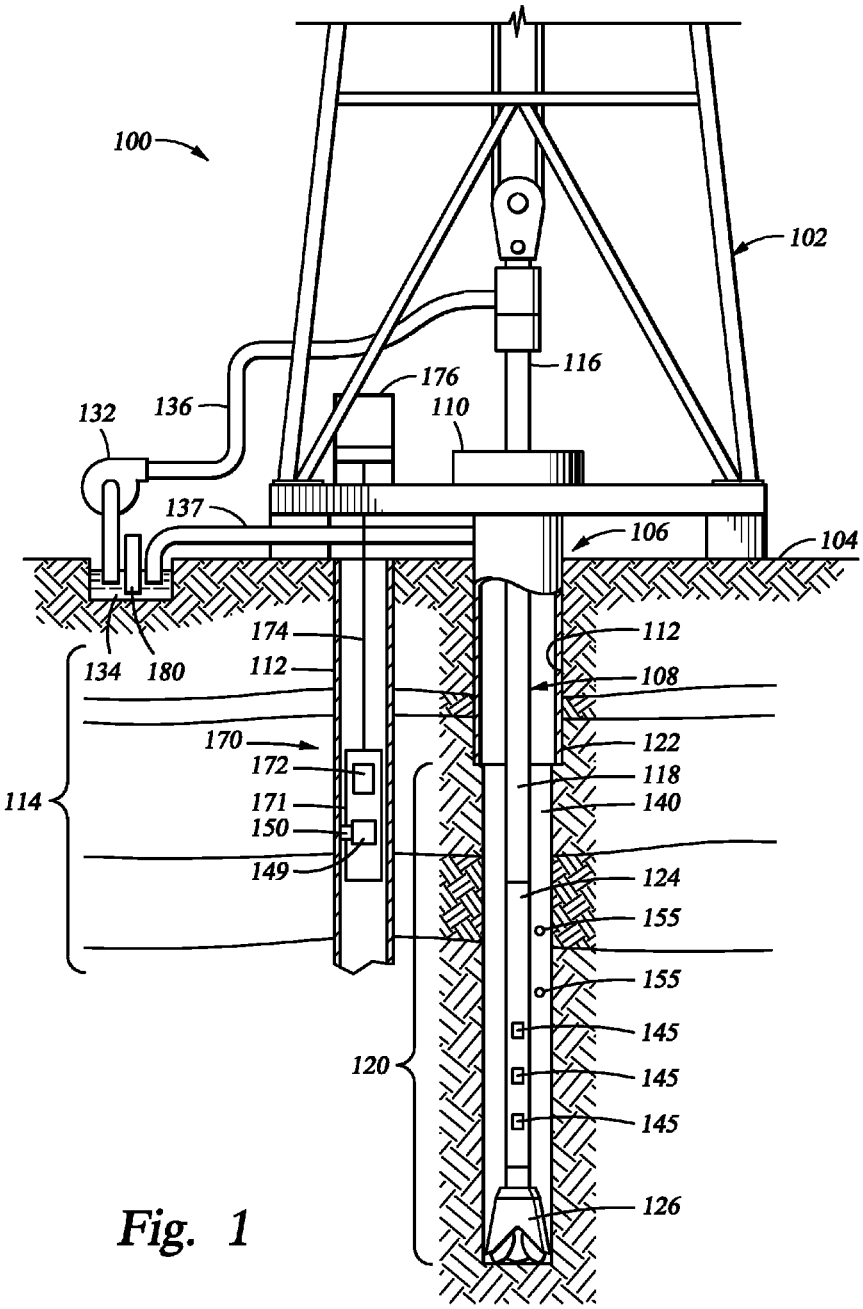
FIG. 1 illustrates a system for testing and drilling operations as constructed in accordance with at least one embodiment.

In the following description of some embodiments of the present invention, reference is made to the accompanying drawings which form a part hereof, and in which are shown, by way of illustration, specific embodiments of the present invention which may be practiced. In the drawings, like numerals describe substantially similar components throughout the several views. These embodiments are described in sufficient detail to enable those skilled in the art to practice the present invention. Other embodiments may be utilized and structural, logical, and electrical changes may be made without departing from the scope of the present invention. The following detailed description is not to be taken in a limiting sense, and the scope of the present invention is defined only by the appended claims, along with the full scope of equivalents to which such claims are entitled.

FIG. 1 illustrates a system 100 for drilling operations. It should be noted that the system 100 can also include a system for pumping operations, or other operations. The system 100 includes a drilling rig 102 located at a surface 104 of a well. The drilling rig 102 provides support for a down hole apparatus, including a drill string 108. The drill string 108 penetrates a rotary table 110 for drilling a borehole 112 through subsurface formations 114. The drill string 108 includes a Kelly 116 (in the upper portion), a drill pipe 118 and a bottom hole assembly 120 (located at the lower portion of the drill pipe 118). The bottom hole assembly 120 may include drill collars 122, a' downhole tool 124 and a drill bit 126. The downhole tool 124 may be any of a number of different types of tools including measurement-while-drilling (MWD) tools, logging-while-drilling (LWD) tools, etc.

During drilling operations, the drill string 108 (including the Kelly 116, the drill pipe 118 and the bottom hole assembly 120) may be rotated by the rotary table 110. In addition or alternative to such rotation, the bottom hole assembly 120 may also be rotated by a motor that is downhole. The drill collars 122 may be used to add weight to the drill bit 126. The drill collars 122 also optionally stiffen the bottom hole assembly 120 allowing the bottom hole assembly 120 to transfer the weight to the drill bit 126. The weight provided by the drill collars 122 also assists the drill bit 126 in the penetration of the surface 104 and the subsurface formations 114.

During drilling operations, a mud pump 132 optionally pumps drilling fluid, for example, drilling mud, from a mud pit 134 through a hose 136 into the drill pipe 118 down to the drill bit 126. The drilling fluid can flow out from the drill bit 126 and return back to the surface through an annular area 140 between the drill pipe 118 and the sides of the borehole 112. The drilling fluid may then be returned to the mud pit 134, for example via pipe 137, and the fluid is filtered.

The downhole tool 124 may include one to a number of different sensors 145, which monitor different downhole parameters and generate data that is stored within one or more different storage mediums within the downhole tool 124. The type of downhole tool 124 and the type of sensors 145 thereon may be dependent on the type of downhole parameters being measured. Such parameters may include the downhole temperature and pressure, the various characteristics of the subsurface formations (such as resistivity, radiation, density, porosity, etc.), the characteristics of the borehole (e.g., size, shape, etc.), etc.

The downhole tool 124 further includes a power source 149, such as a battery or generator. A generator could be powered either hydraulically or by the rotary power of the drill string. The downhole tool 124 includes a formation testing tool 150, which can be powered by power source 149. In an embodiment, the formation testing tool 150 is mounted on a drill collar 122. The formation testing tool 150 includes a probe that engages the wall of the borehole 112 and extracts a sample of the fluid in the adjacent formation via a flow line. The probe includes one or more inner channels and one or more outer channels, where the one or more outer channels captures more contaminated fluid than the one or more inner channels. As will be described later in greater detail, the probe samples the formation and, in an option, inserts a fluid sample in a container 155. In an option, the tool 150 injects the carrier 155 into the return mud stream that is flowing intermediate the borehole wall 112 and the drill string 108, shown as drill collars 122 in FIG. 1. The container(s) 155 flow in the return mud stream to the surface and to mud pit or reservoir 134. A carrier extraction unit 160 is provided in the reservoir 134, in an embodiment. The carrier extraction unit 160 removes the carrier(s) 155 from the drilling mud.

FIG. 1 further illustrates an embodiment of a wireline system 170 that includes a downhole tool body 171 coupled to a base 176 by a logging cable 174. The logging cable 174 may include, but is not limited to, a wireline (multiple power and communication lines), a mono-cable (a single conductor), and a slick-line (no conductors for power or communications). The base 176 is positioned above ground and optionally includes support devices, communication devices, and computing devices. The tool body 171 houses a formation testing tool 150 that acquires samples from the formation. In an embodiment, the power source 149 is positioned in the tool body 171 to provide power to the formation testing tool 150. The tool body 171 may further include additional testing equipment 172. In operation, a wireline system 170 is typically sent downhole after the completion of a portion of the drilling. More specifically, the drill string 108 creates a borehole 112. The drill string is removed and the wireline system 170 is inserted into the borehole 112.

Figure 2:
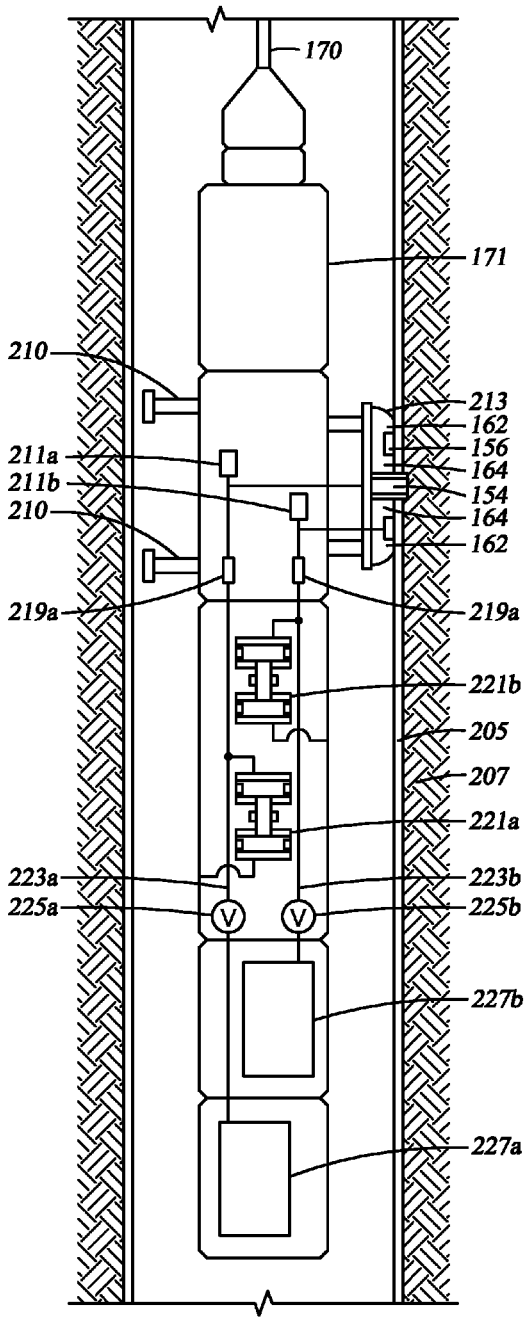
FIG. 2 illustrates a wireline system for drilling operations as constructed in accordance with at least one embodiment.

FIG. 2 illustrates the formation testing tool 150 in greater detail. As mentioned above, the formation testing tool 150 can be included on the wireline system 170 or a drilling system, for example. It should be noted the formation testing tool 150 can be included on other tools, including, but not limited to tools that lower themselves into the borehole. In FIG. 2, an example of the wireline system is shown with formation testing tool 150.

A portion of a borehole 201 is shown in a subterranean formation 207. The borehole wall is covered by a mudcake 205. The formation tester body 171 is connected to a wireline system 170 leading from a rig at the surface (FIG. 1). The formation tester body 171 is provided with a mechanism, denoted by 210, to clamp the tester body at a fixed position in the borehole. In an option, the clamping mechanism 210 is at the same depth as a probe 152. Other mechanisms for engaging the probe 152 with the borehole include, but are not limited to inflatable packers.

Figure 8:
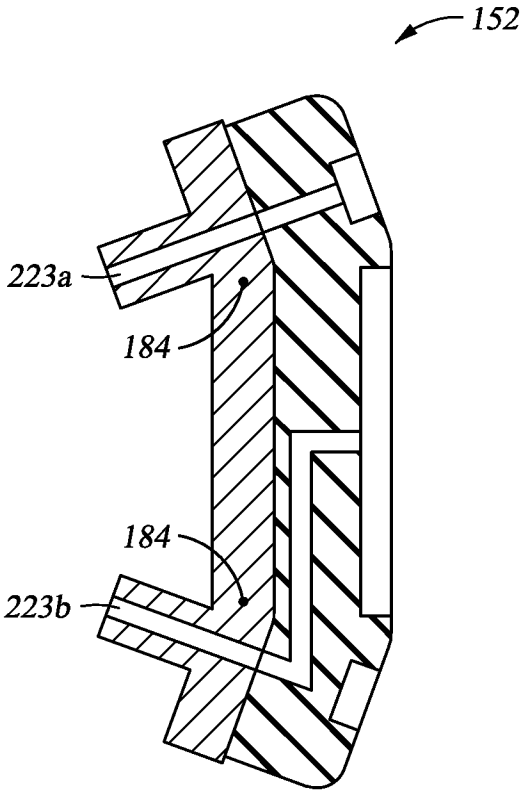
FIG. 8 illustrates a side view of a probe as constructed in accordance with at least one embodiment.

In an example, a clamping mechanism 210 and a fluid sampling pad 213 are extended and mechanically pressed against the borehole wall. The fluid sampling pad 213 includes a probe 152 that has one or more outer channel 156, and one or more inner channel 154. The inner channel(s) 154 is disposed within at least a portion of the outer channel(s) 156. In an option, the inner channel(s) 154 is extended from the center of the pad, through the mud cake 205, and pressed into contact with the formation. For instance, the inner channel(s) 156 is connected by a hydraulic flow line 223a to an inner channel sample chamber 227*a*. In another option, the fluid sample pad 213 is extended via extendable members 211 (FIGS. 6 and 7), and the inner and outer channels 154, 156 can contact the formation. In an option, flow lines 223*a*, 223*b* for the inner and/or outer channels 154, 156 extend through the extendable members 211, and to their respective channels. In a further option, the probe 152 is an articulating probe, where the probe can hinge at one or more locations 184 (FIG. 8) to contact the surface of a formation and borehole more readily.

Figure 7:
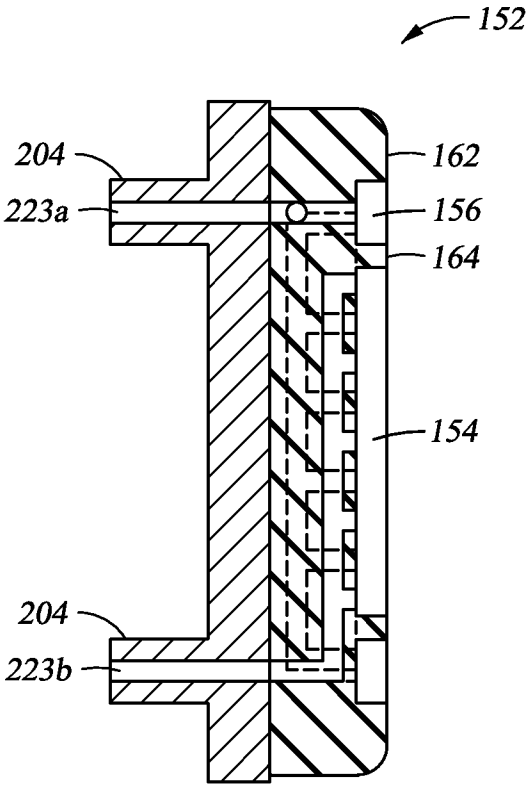
FIG. 7 illustrates a side view of a probe as constructed in accordance with at least one embodiment.
Figure 6:
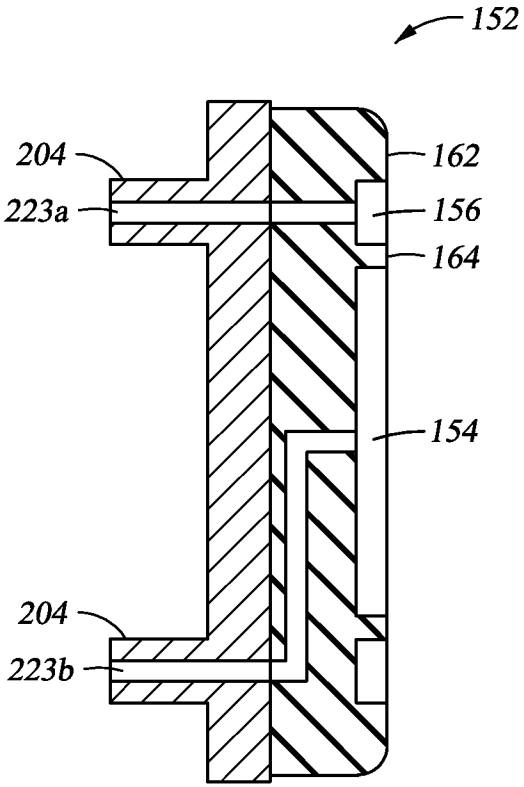
FIG. 6 illustrates a side view of a probe as constructed in accordance with at least one embodiment.
Figure 9:
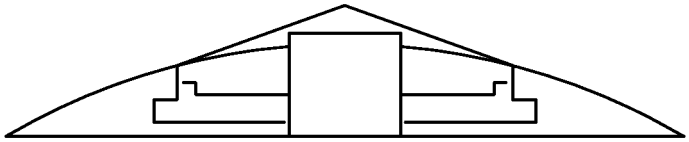
FIGS. 9-16 illustrate an example of a retractable wiper for a probe as constructed in accordance with at least one embodiment.
Figure 10:
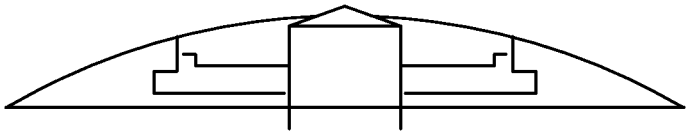
Figure 11:
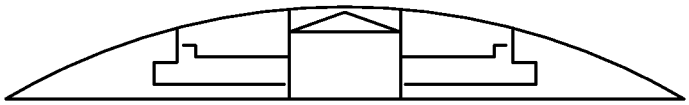
Figure 12:
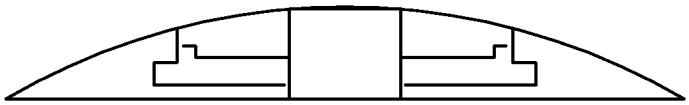
Figure 13:
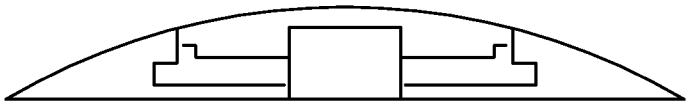
Figure 14:
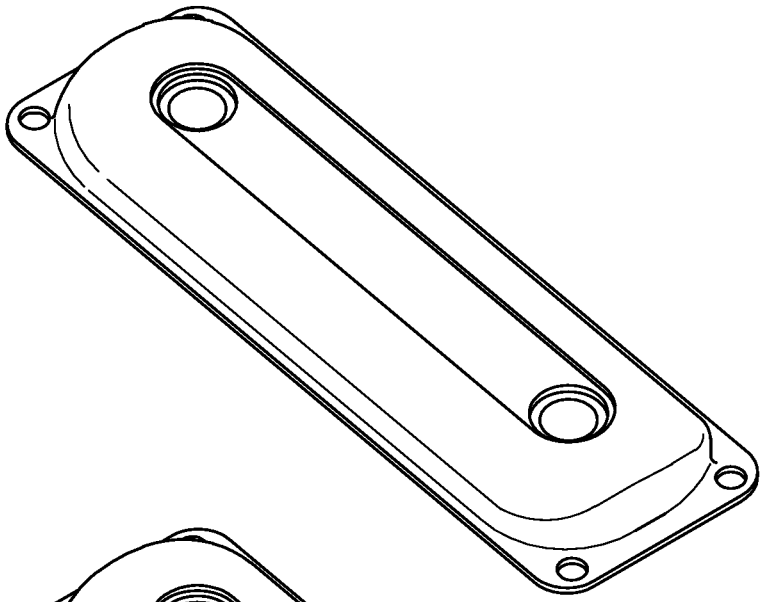
Figure 15:
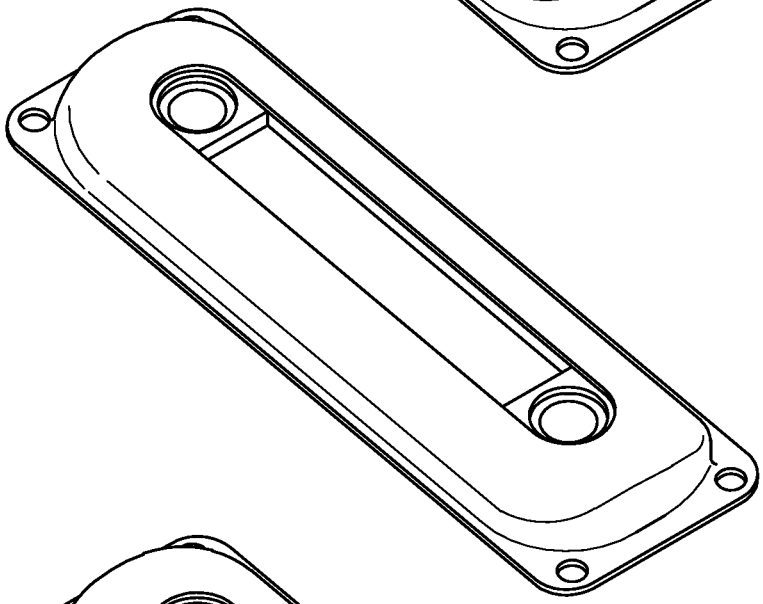
Figure 16:
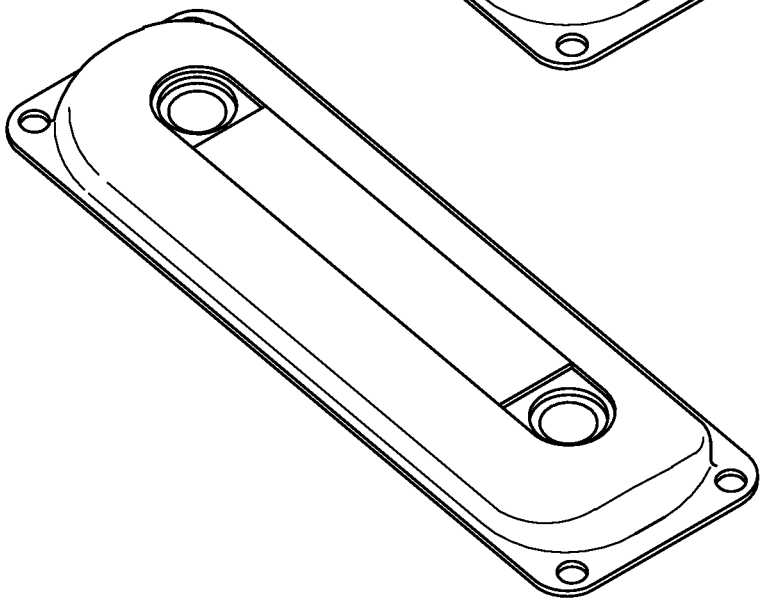

The outer channel(s) 156 has one or more openings 158 (FIG. 3) therealong, the openings being hydraulic connected with the formation thru the channel. Optionally the outer channel(s) can be directly contacting the formation. All of the openings can be connected to one or more hydraulic lines with in the body of the tool. In an option, the outer channel(s) 156 is connected by its own hydraulic flow line, 223*b*, to an outer channel sample chamber, 227*b*. Because the flow line 223*a* of the inner channel(s) 154 and the flow line 223*b* of the outer channel(s) 156 are separate, the fluid flowing into the outer channel(s) 156 does not mix with the fluid flowing into the inner channel(s) 154. The outer channel(s) can 156 isolate the flow into the inner channel(s) 154 from the borehole beyond the pad 213. In a further option, the inner channel flow line 223*a* and/or the outer channel flow line 223*b* extend through extendable members 204 (FIGS. 6 and 7).

The hydraulic flow lines 223*a* and 223*b* are optionally provided with pressure transducers 211*a* and 211*b*. In an option, the pressure maintained in the outer channel flowline 223*b* is the same as, or slightly less than, the pressure in the inner channel flowline 223*a*. In another option, the pressure ratio maintained in the inner channel flowline 223*a* to the outer channel flowline 223*b* is about 2:1 to 1:2. In another option, the flow rates of the inner channel(s) 154 and the outer channel(s) 156 are regulated. For example, the flow rate ration of the inner channel(s) 154 to the outer channel(s) 156 is about 2:1 to 1:2. With the configuration of the pad 213 and the outer channel(s) 156, contaminated borehole fluid that flows around the edges of the pad 213 is drawn into the outer channel(s) 156, and diverted from entry into the inner channel(s) 154.

The flow lines 223*a* and 223*b* are optionally provided with pumps 221*a* and 221*b*, or other devices for flowing fluid within the flow lines. The pumps 221*a* and 221*b* are operated long enough to substantially deplete the invaded zone in the vicinity of the pad 213 and to establish an equilibrium condition in which the fluid flowing into the inner channel(s) 154 is substantially free of contaminating borehole filtrate.

The flow lines 223*a* and 223*b* are also provided with fluid identification sensors, 219*a* and 219*b*. This makes it possible to compare the composition of the fluid in the inner channel flowline 223*a* with the fluid in the outer channel flowline 223*b*. During initial phases of operation, the composition of the two fluid samples will be the same; typically, both will be contaminated by the borehole fluid. These initial samples are discarded. As sampling proceeds, if the borehole fluid continues to flow from the borehole towards the inner channel(s) 154, the contaminated fluid is drawn into the outer channel(s) 156. Pumps 221*a* and 221*b* discharge the sampled fluid into the borehole. At some time, an equilibrium condition is reached in which contaminated fluid is drawn into the outer channel(s) 156 and uncontaminated fluid is drawn into the inner channel(s) 154. The fluid identification sensors 219*a* and 219*b* are used to determine when this equilibrium condition has been reached. At this point, the fluid in the inner channel flowline is free or nearly free of contamination by borehole fluids. Valve 225*a* is opened, allowing the fluid in the inner channel flowline 223*a* to be collected in the inner channel sample chamber 227*a*. Similarly, by opening valve 225*b*, the fluid in the outer channel flowline 223*b* is collected in the outer channel sample chamber 227*b*. Alternatively, the fluid gathered in the outer channel(s) can be pumped to the borehole while the fluid in the inner channel flow line 223*a* is directed to the inner channel sample chamber 227*a*. Sensors that identify the composition of fluid in a flowline can also be provided, in an option.

Figure 5:
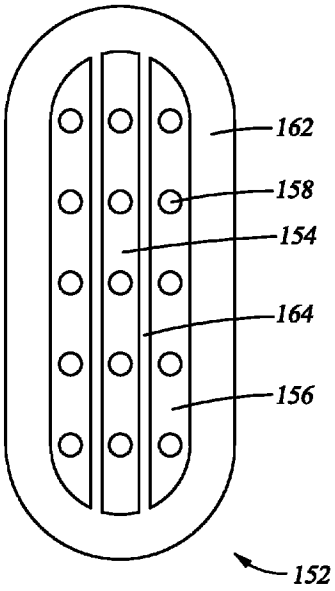
FIG. 5 illustrates a probe as constructed in accordance with at least one embodiment.
Figure 4:
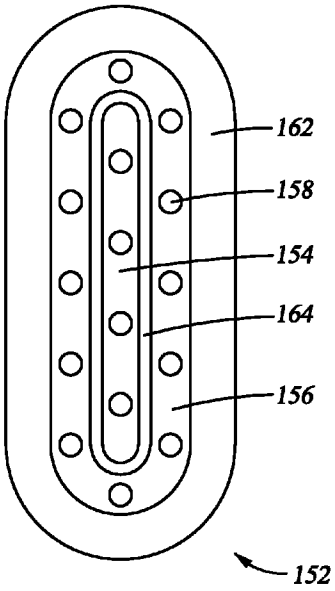
FIG. 4 illustrates a probe as constructed in accordance with at least one embodiment.
Figure 3:
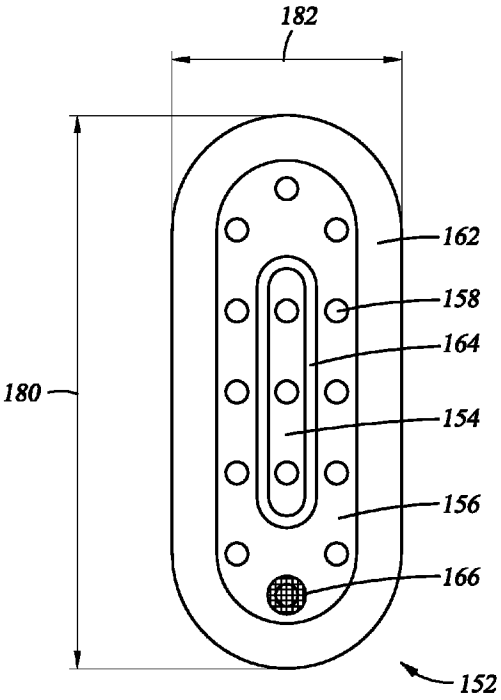
FIG. 3 illustrates a probe as constructed in accordance with at least one embodiment.

FIGS. 3-5 illustrate additional variations for the probe 152. The probe 152 is defined by a height 180 and a width 182. In an option, the probe has an elongate shape and the height 180 is greater than the width 182. This allows for the probe 152 to contact a greater number of laminates. In another option, the probe 152 has an overall oval shape.

As discussed above, the probe 152 includes inner and outer channels 154, 156, and the inner and outer channels 145, 156 include a number of openings 158 or ports therein, where fluid flows through the openings 158. The number of flow ports, in an option, in the outer channel(s) 156 is different than in the inner channel(s) 154. In an option, the outer channels 156 have an overall oval, elongate shape and/or encircle with inner channel(s) 154. While an elongate or oval shape are discussed, it should be noted other shapes for the probe or outer channels can be used. Furthermore, the area of the outer channel(s) 156 relative to the area of the inner channel(s) 154 can be varied, for example, as seen in FIGS. 3 and 4. In another option, the outer channel(s) 156 do not completely encircle the inner channel(s) 154, as shown in FIG. 5. For example, the outer channel(s) 156 are disposed on one or more sides of the inner channel(s) 154.

In a further option, the probe 152 includes an outer sealing member such as a seal 162 that encircles the outer channel(s) 156, as shown in FIG. 3. In further option, the probe 152 includes a seal 164 disposed between the outer channel(s) 156 and the inner channel(s) 154, where the seal 164 is optionally retractable within the probe 152. The seals 162, 164 seal against the bore hole wall to enclose a contact surface therein. The seals can be made of elastomeric material, such as rubber, compatible with the well fluids and the physical and chemical conditions expected to be encountered in an underground formation.

The probe 152 can be operated, cleansed, or kept cleansed in a number of manners. For example, the probe 152 includes one or more screens 166 over the openings 158. In an option, the one or more screens 166 are retractable to promote flow. Although only one screen 166 is shown in FIG. 3, the screens 166 can be disposed over one or more of the openings 158 for the inner channel(s) 154 and/or the outer channel(s) 156. In another option, the probe further includes at least one wiper that excludes or assists in excluding mud entry into the inner or outer channels.

In another example, fluid can be pumped through the probe 152 in various manners, such as out of the inner and/or outer channels 154, 156 or into the inner and/or outer channels 145, 156. For instance, fluid is pumped through the probe 152 clearing the inner channel(s) 154 including pumping fluid out of the inner channel(s) 154 while optionally pumping into the outer channel(s) 156. In a further option, fluid is pumped through the probe 152 clearing the outer channel(s) 156 including pumping fluid out of the outer channel(s) 156 while optionally pumping into the inner channel(s) 154. In another option, fluid pump through the probe 152 is a selected fluid, such as a fluid that is capable of dissolving material that can clog formation pores near the probe. The fluid can be stored in a collection chamber that can be prefilled, or empty.

In yet another option, mud cake can be displaced, including removed, adjacent the seals, the inner channel member, or the outer channel member. For example, a wiper assembly as shown in FIG. 9-16 can be included with the above-discussed probe 152. The wiper assembly includes a retractable wiper. The wiper can be used to remove or exclude mud cake from the probe as the pad sets.

Advantageously, the formation samples with low levels of contamination can be collected more quickly using the formation tester. Furthermore, the probe can be self cleaning without having to remove the probe from the borehole. This can increase the efficiency of the pumping or drilling operations. Furthermore, the probe allows for a thin layer or fracture to be identified because the probe can capture a layer or fracture by spanning vertically along the well bore.

Reference in the specification to "an option," "an embodiment," "one embodiment," "some embodiments," or "other embodiments" means that a particular feature, structure, or characteristic described in connection with the options or embodiments is included in at least some embodiments, but not necessarily all embodiments, of the invention. The various appearances of "an embodiment," "one embodiment," or "some embodiments" are not necessarily all referring to the same embodiments.

Although specific embodiments have been described and illustrated herein, it will be appreciated by those skilled in the art, having the benefit of the present disclosure, that any arrangement which is intended to achieve the same purpose may be substituted for a specific embodiment shown. This application is intended to cover any adaptations or variations of the present invention. Therefore, it is intended that this invention be limited only by the claims and the equivalents thereof.

What is claimed is:

1. A method for testing a formation, the method comprising:

pumping fluid through a probe including one or more inner channels and one or more outer channels, where the probe is defined by a height and a width, and the heigreater than the width to define an elongate shape for the one or more inner channels and the one or more outer channels;

regulating at least one of flow rates or pressures between the one or more inner channels and the one or more outer channels; and clearing the one or more inner channels including pumping fluid out of the one or more inner channels while pumping into the one or more outer channels or clearing the one or more outer channels including pumping fluid out of the one or more outer channels while pumping into the one or more inner channels.

2. The method of claim 1, wherein the method includes pumping fluid into the probe through the one or more inner channels or the one or more outer channels.

3. The method of claim 1, wherein the method includes pumping fluid out of the probe through the one or more inner channels or the one or more outer channels.

4. The method of claim 1, wherein the method includes pumping a selected fluid from a collection chamber out of the probe through the one or more inner channels or the one or more outer channels.

5. The method of claim 1, wherein the method includes maintaining a pressure ratio or a flow rate ratio of the one or more inner channels to the one or more outer channels of about 2:1 to 1:2.

6. The method of claim 1, wherein the method includes pumping, from a prefilled collection chamber, a selected fluid capable of dissolving material that can clog formation pores near the probe.

7. The method of claim 1, wherein the method includes displacing mud cake adjacent at least one of an outer sealing member, or the one or more inner channels, or the one or more outer channels.

8. The method of claim 7, wherein displacing mud cake includes moving at least one wiper relative to the one or more inner or outer channels.

9. The method of claim 1, wherein the probe includes a sealing member between the one or more inner flow channels and the one or more outer flow channels.

10. The method of claim 1, wherein using the probe includes using a first flow path and a second flow path, the first flow path communicatively coupled with the one or more inner channels, and the second flow path communicatively coupled with the one or more outer channels.

11. The method of claim 1, wherein the probe includes the one or more inner channels having a different area of flow ports than the one or more outer channels.

12. The method of claim 1, wherein the probe includes at least one screen associated with at least one of the inner channels or the outer channels.

13. The method of claim 1, wherein the probe includes a retractable sealing member disposed between the one or more inner flow channels and the one or more outer flow channels.

14. The method of claim 1, wherein the method includes operating two pumps for a sufficient amount of time to substantially deplete an invaded zone in vicinity of a pad including the probe and to establish an equilibrium condition in which fluid flowing into the one or more inner channels is substantially free of contaminating borehole filtrate.

* * * * *